US011624563B2

(12) United States Patent
Shaw

(10) Patent No.: US 11,624,563 B2
(45) Date of Patent: Apr. 11, 2023

(54) LOCK STRIP FOR HEAT EXCHANGER

(71) Applicant: SPX Flow, Inc., Charlotte, NC (US)

(72) Inventor: Jonathan Graham Shaw, Goldsboro, NC (US)

(73) Assignee: SPX Flow, Inc., Charlotte, NC (US)

( * ) Notice: Subject to any disclaimer, the term of this patent is extended or adjusted under 35 U.S.C. 154(b) by 250 days.

(21) Appl. No.: 17/165,381

(22) Filed: Feb. 2, 2021

(65) Prior Publication Data

US 2022/0243999 A1 Aug. 4, 2022

(51) Int. Cl.
*F28F 3/10* (2006.01)

(52) U.S. Cl.
CPC ..... *F28F 3/10* (2013.01); *F28F 2265/16* (2013.01); *F28F 2265/26* (2013.01)

(58) Field of Classification Search
CPC ..... F28F 3/10; F28F 2265/16; F28F 2265/26
See application file for complete search history.

(56) References Cited

U.S. PATENT DOCUMENTS

| | | | | |
|---|---|---|---|---|
| 6,073,687 | A * | 6/2000 | Jensen | F28F 3/083 165/166 |
| 6,186,224 | B1 * | 2/2001 | Seidel | F28F 3/10 165/166 |
| 6,935,415 | B1 * | 8/2005 | Petersen | F28F 3/10 165/166 |
| 8,544,529 | B2 * | 10/2013 | Noel-Baron | F28F 3/083 165/166 |
| 9,212,854 | B2 * | 12/2015 | Krantz | F28F 3/083 |
| 10,544,998 | B2 * | 1/2020 | Hedberg | F28F 3/10 |
| 2016/0282060 | A1 * | 9/2016 | Rasmussen | F28D 9/0093 |
| 2019/0219341 | A1 * | 7/2019 | Petersen | F28F 3/10 |

* cited by examiner

*Primary Examiner* — Devon Russell
(74) *Attorney, Agent, or Firm* — IceMiller LLP

(57) ABSTRACT

A heat exchanger with improved leak prevention may include a first heat exchanger plate, a second heat exchanger plate, a gasket between the first and the second heat exchanger plates, and a lock strip configured to maintain alignment of the first and second heat exchanger plates over a plurality of thermal expansion and contraction cycles of the plates. The lock strip may include at least one projection to engage with a projection of the first and/or second heat exchanger plate to secure its position over the plurality of thermal expansion and contraction cycles of the plates. Lock strips can be applied to one or many plates comprising a plate heat exchanger plate pack.

17 Claims, 9 Drawing Sheets

LOCK STRIP FOR HEAT EXCHANGER

FIELD OF THE INVENTION

The disclosure generally relates to a lock strip for a plate heat exchanger. More particularly, the disclosure relates to a lock strip to increase leak prevention from heat exchanger plates.

BACKGROUND OF THE INVENTION

It is known that plate type heat exchanger provides efficient heat transfer between heat transfer mediums. A pack of heat exchanger plates may have a port portion, wherein heat exchanger plates are connected to adjacent heat exchanger plate via an elastomeric gasket seal so that an interconnecting fluid transfer port is created between adjacent heat exchanger plates. The port portion will allow a first heat transfer medium to flow into and communicate with every other flow passage between the heat exchanger plates and a second heat transfer medium to flow into and communicate with remaining flow passages between the heat exchanger plates.

One disadvantage with elastomeric gasket sealed heat exchangers is that in order to make an elastomeric seal operate it is necessary to compress the gasket.

To compress the gasket seals and maintain adjacent plate to plate contact, two outer frames, sometimes referred to as a head and a follower, may be provided to keep the heat exchange plates together. Gaskets may be arranged between heat exchanger plates to define heat transfer medium flow passages. Heat exchanger plates may even have grooves on their surfaces so that gaskets may sit within to prevent movement of the gaskets. Heat exchanger plates may be pressed together by pressing the head and the follower with a force sufficient to form a gasket seal and heat transfer medium may be operated in a higher pressure.

With this configuration, heat exchanger may have versatility and flexibility to effectively meet various heat exchange demands, such as improving temperature control, varying the number of plates to increase, restreaming or rearranging the flow-paths so as to better control of pressure drops or decrease to reduce maintenance costs.

However, a plate type heat exchanger with a gasket also has disadvantages. One of the disadvantages of a heat exchanger using gasket is possibility for leakage. A heat transfer medium may be provided into an inlet port, either from the head or the follower, in a high temperature to transfer heat to another heat transfer medium. At the start up, this hot medium enters a cold heat exchanger and rapidly heats up the plates as it travels through the plate channels. Not all plates are heated simultaneously, and there is a period of time where the temperature is highly non-uniform. This is particularly true for the end plates that are in direct mechanical and thermal contact with the enclosing frame members, the head and follower plates. The first and last fluid passage adjacent to the frame members receives heat from only one side whereas all other channels receive or lose heat through 2 passage sides. This means that even under steady state operation, these end plates will operate with different temperature profiles than other plates in the plate pack. Unsteady state or cyclic operation, changes in inlet temperatures or flow rates, can produce constantly changing amounts of thermal expansion between plates within a plate pack, so this nonuniformity of temperature is not confined to the start up or shut down condition.

It is well known that a material expands as its temperature increases. When a heat transfer medium is provided into an inlet port and increases temperature, heat exchanger plates and gaskets between them will expand by an amount directly proportional to the change in temperature. Because the temperature change is not always constant, plates may expand by different amounts within the same plate pack. As some heat exchanger plates and gaskets change dimensionally due to expansion, the seal between them may be compromised by the relative displacement produced between plates. If the relative movement of adjacent plates is such that the gasket sealing surfaces no longer align with the sealing surface of the mating plate, then this will cause leakage.

There may be two types of leakage in heat exchangers. One is an external leak where the heat transfer medium leaks out to the atmosphere. This can be visibly detected and corrected but requires the heat exchanger to be taken out of service and opened to effect repairs. The other type is an internal leakage or intermixing of heat transfer mediums. Internal leakage without simultaneous external leakage cannot be caused by lose of gasket seal or plate to plate movement.

Therefore, it is desirable for a plate type heat exchanger to have an improved leak prevention between heat exchanger plates by reducing and limiting the relative plate movement between adjacent plates.

SUMMARY OF THE INVENTION

An aspect of the disclosure pertains to a heat exchanger with improved leak prevention comprising: a first heat exchanger plate having first fluid passages and second fluid passages; a second heat exchanger plate having first fluid passages and second fluid passages; a gasket arranged between the first and second heat exchanger plates and configured to separate the first fluid passages from the second fluid passages; a lock strip arranged between the first and second heat exchanger plates and configured to maintain alignment of the first and second heat exchanger plates over a plurality of thermal expansion and contraction cycles of the plates.

Another aspect of the disclosure includes a lock strip for maintaining alignment of heat exchanger plates, comprising: a first projection configured to engage with a first indentation on a first heat exchanger plate; a second projection configured to engage with a first indentation on a second heat exchanger plate; and a hook-shaped region configured to surround a projection of the first heat exchanger plate.

Still another aspect of the disclosure includes a method of making a heat exchanger with improved leak prevention comprising steps of: preparing a first heat exchanger plate; perforating at least one heat transfer medium inlet and at least one heat transfer medium outlet; pressing edges of the first heat exchanger plate to form projections and an indentations; placing a gasket to separate a first fluid passage and a second fluid passage; and installing a lock strip on at least one edge of the first heat exchanger plate such that a projection of the lock strip engages with the indentation of the first heat exchanger plate and a hook-shaped region surrounds the projection of the first heat exchanger plate.

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the disclosure. It is important, therefore, that the claims be regarded as including such equivalent constructions insofar as they do not depart from the spirit and scope of the disclosure.

BRIEF DESCRIPTION OF THE DRAWINGS

The foregoing summary, as well as the following detailed description of the invention, will be better understood when read in conjunction with the appended figures. For the purpose of illustrating the invention, the figures demonstrate embodiments of the present invention. It should be understood, however, that the invention is not limited to the precise arrangements, examples, and instrumentalities shown.

DETAILED DESCRIPTION

The foregoing and other objectives, features, and advantages of the disclosure will become more apparent from the following detailed description taken in conjunction with the accompanying drawings.

Hereinafter, a heat exchanger with improved leak prevention, a lock strip for maintaining alignment of heat exchanger plates and a method of making the heat exchanger with improved leak prevention according to the disclosure will be described in detail with reference to the accompanying drawings. The described aspects are provided so that those skilled in the art can easily understand the technical spirit of the disclosure, and thus the disclosure is not limited thereto. In addition, the accompanying drawings are schematic drawings for easily understand and the aspects of the disclosure and thus the matters represented in the accompanying drawings may be different from those actually implemented.

Meanwhile, each component shown below is only an example for implementing the disclosure. Therefore, other components may be used in other implementations of the disclosure without departing from the spirit and scope of the disclosure.

Additionally, it should be understood that the expression "including" certain elements is an "open type" expression indicating certain components and does not exclude additional components.

Reference in this specification to "one aspect," "an aspect," "other aspects," "one or more aspects" or the like means that a particular feature, structure, or characteristic described in connection with the aspect is included in at least one aspect of the disclosure. The appearances of, for example, the phrase "in one aspect" in various places in the specification are not necessarily all referring to the same aspect, nor are separate or alternative aspects mutually exclusive of other aspects. Moreover, various features are described which may be exhibited by some aspects and not by others. Similarly, various requirements are described which may be requirements for some aspects but not for other aspects.

Figure 1:
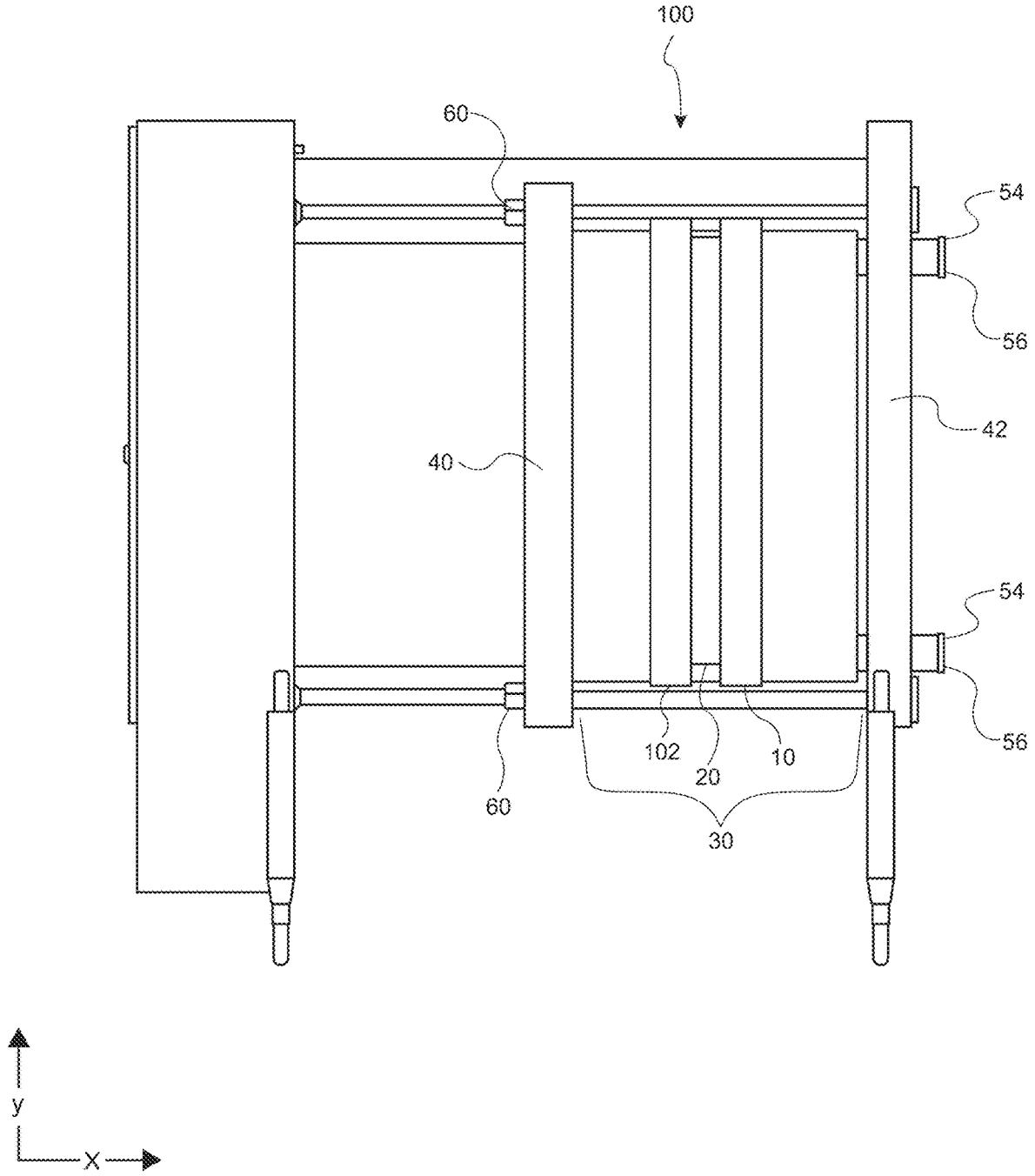
FIG. 1 is a side view of a heat exchanger using gaskets according to an aspect of the disclosure.

FIG. 1 is a side view of a heat exchanger using gaskets according to an aspect of the disclosure.

In FIG. 1, a heat exchanger 100 with improved leak prevention is illustrated. The heat exchanger 100 may include a first heat exchanger plate 10 and a second heat exchanger plate 102. The first heat exchanger plate 10 and the second heat exchanger plate 102 are arranged in spaced back-to-face relationship. A gasket 20 may be arranged between the first heat exchanger plate 10 and the second heat exchanger plate 102. The first heat exchanger plate 10 and the second heat exchanger plate 102 may, as a pair, be repeated many times to constitute a plate pack 30. The length of the heat exchanger plate pack may be less than one inch to several meters.

The heat exchanger plate pack 30 may be arranged between a first end plate 42 (also called as a "head") and a second movable end plate 40 (also called as a "follower"). The first end plate 42 may be arranged with a first inlet 50 at the top left-hand side and a second inlet 54 (hidden behind the first outlet 56) at the bottom right-hand side. The first end plate 42 may be also arranged with a first outlet 56 at the bottom left hand side and a second outlet 52 (hidden behind the first inlet 50) at the top right hand side. The first inlet 50, the second inlet 54, the first outlet 56, and the second outlet 52 may be configured to allow flow of heat transfer mediums into the plate pack through the first end plate 42. In the heat exchanger plate pack 30, the front face of the second heat exchanger plate 102 faces towards the first end plate 42 and the back face of the first heat exchanger plate 10 faces the second end plate 40.

In order to prevent leakage from the flow of heat transfer mediums, the second end plate 40 and the first end plate 42 may be pressed together with a force sufficient to form a gasket seal there between and maintain constant plate to plate contact. The first end plate 40 and the second end plate 42 may be connected with a tightening member 60. The tightening member 60 may include any tightening mechanism known to a person with ordinary skill in the art. By way of example, the tightening member 60 may include a bolt and a nut or "Tie bar", so that the first end plate 42 and the second end plate 40 may be pressed by rotating the bolt of the tightening member 60. The first end plate 42 and the second end plate 40 may be connected with more than one tightening member 60. By means of the tightening members the second end plate 40 is caused to move towards the first end plate 42 thereby causing all components in the plate pack 30 to become compressed.

Figure 2:
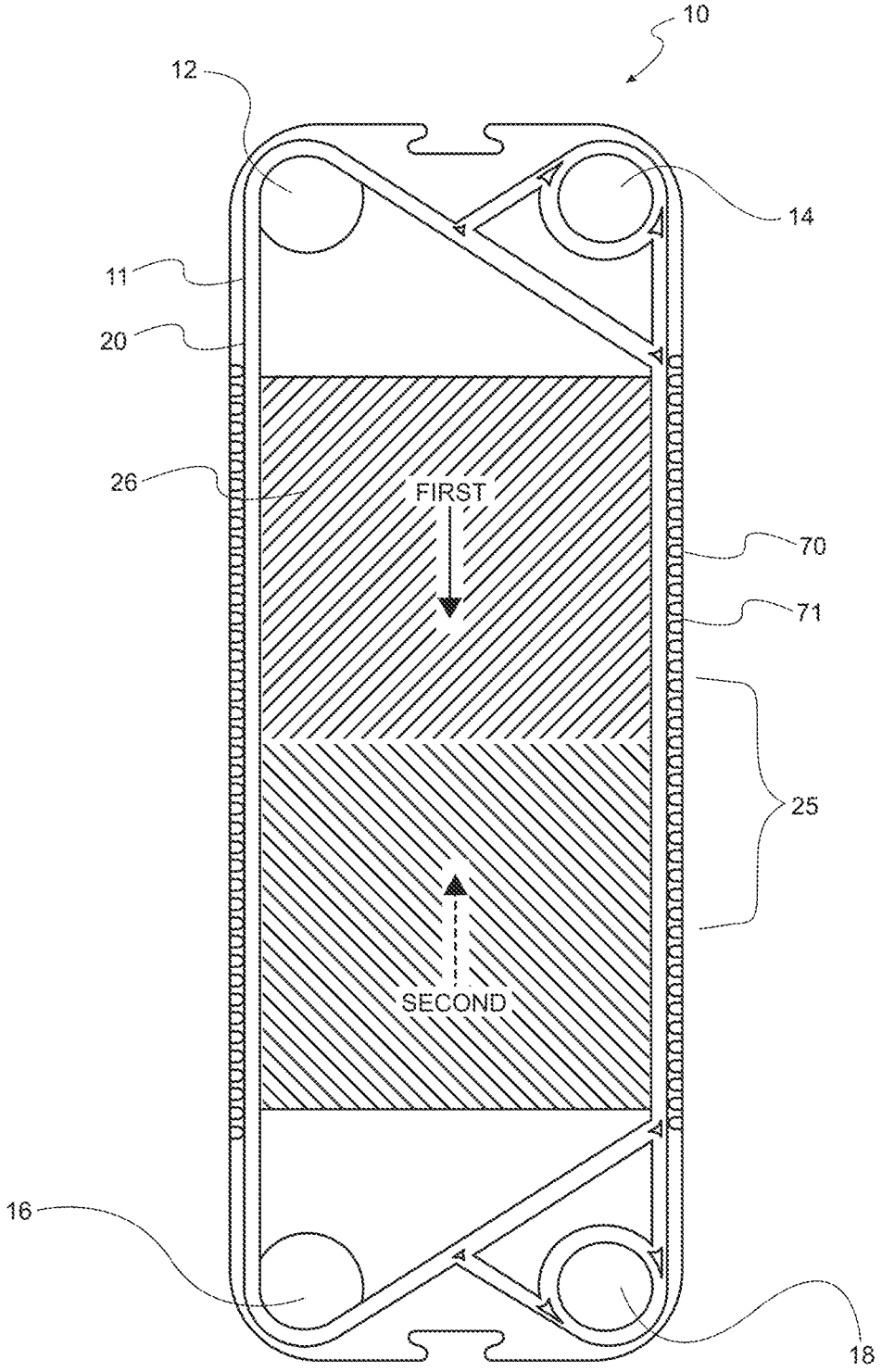
FIG. 2 is a plain view of a heat exchanger plate with an exemplary gasket pattern according to an aspect of the disclosure. This also exhibits the raised projections and indentations along the two outside edges of the plate called castellations.

FIG. 2 is a plain view of a heat exchanger plate with an exemplary gasket pattern according to an aspect of the disclosure. This plate exhibits raised projections and indentations "castellations" along the two outside edges of the plate.

In FIG. 2, a heat exchanger plate with an exemplary gasket pattern is illustrated. By way of example, the first heat exchanger plate 10 is shown here. The first heat exchanger plate 10 may be configured with a first heat transfer medium inlet 12 and a first heat transfer medium outlet 16. A first heat transfer medium flows across the front face of the first heat exchanger plate 10. The first heat exchanger plate 10 may be also configured with a second heat transfer medium inlet 18 and a second heat transfer medium outlet 14, and they allow the second heat transfer medium to flow along the backside face of the first heat exchanger plate 10.

The purpose of the heat exchanger 100 is to transfer heat from the first heat transfer medium to the second heat transfer medium, or vice versa through the metal plate by conduction. The plate maintains a physical barrier keeping the two mediums separated. The first and the second heat transfer mediums may be both of liquid or one stream of liquid and one stream of vapor or two streams of vapor. In some cases, one or both streams may have mixed liquid and vapor phases.

Within the heat transfer surface of the plate, there is pressed a trough pattern 26 which serves to increase turbulation of the heat transfer medium passing through the channel thereby increasing the heat transfer rate. Around the outside area enclosed by the gasket groove heat transfer plates have a pressed structure consisting of alternating projections 71 and indentations 70 called collectively "castellations" 25. In this figure these are shown only down the long sides of the plate 10 but may in practice run completely around the periphery of the plate 10. In this aspect of the disclosure, all the heat transfer plates in the pack are identical components but alternate in the pack by rotating adjacent plates through 180 degrees.

All adjacent plates have troughs that cross and abut forming a rigid structure that maintains the fluid passage channel gap produced between plates. In the same manner the outside castellations form a honeycomb like structure that helps to keep the gasket compressed and able to prevent fluid pressure from forcing the plates apart.

In this aspect of the disclosure, the first heat transfer medium may flow from the first heat transfer medium inlet 12 down the front side of the heat transfer plate 10 and out through the first heat transfer medium outlet 16. The second heat transfer medium may flow through the second heat transfer medium inlet 18 until it enters along the back side of the plate 10 and out through the second heat transfer medium outlet 14. By way of example, an area between the first heat transfer medium inlet 12 and the first heat transfer medium outlet 16 may include a first fluid passage, and areas of the second heat transfer medium inlet 18 and the second heat transfer medium outlet 14 may include a second fluid passage on the back side of the plate.

It is important that two heat transfer mediums be kept out of contact, in other words, prevent internal leakage, especially for food products. This is accomplished by the metal of the plate which provides a mechanical barrier and the gaskets that direct the flow to front and back side of the heat transfer plate maintaining medium separation. Therefore, a gasket 20 is provided configured to separate the first fluid passage and the second fluid passage. The gasket 20 is fitted to the front face of plate 10. For better internal leak prevention, it is important that the gasket 20 does not overlap the ports 12, 14, 16, and 18. It is also important to fix the position of the gasket 20 so that the gasket does not move to overlap the ports 12, 14, 16, and 18 or be moved outwards off the plate.

To prevent the gasket 20 from moving when pressed, the first heat exchanger plate 10 may have a groove 11 pressed down into the front face of which the gasket is fitted and therein to secure the position of gasket 20. The pattern of the groove 11 in FIG. 2 show an exemplary aspect; and the groove 11 may take different pattern. The second heat exchanger plate 102 may have a same pattern of groove as the first heat exchanger plate 10 so that when they are placed against each other, the gasket 20 will hold the position between the first heat exchanger plate 10 and the second heat exchanger plate 102.

The gasket 20 may be formed from various types of materials commonly utilized for this purpose and must be capable of withstanding the temperatures and pressures to be encountered when the heat transfer mediums flow within the fluid passages. Furthermore, the gasket 20 material must be inert to such heat transfer mediums. The manufacture of the gasket 20 may be carried out in molds, but according to the size of the heat exchanger plate or the manufacturing techniques used the gasket may be assembled from two or more smaller components. The gasket 20 may be made from an elastic material.

Figure 3:
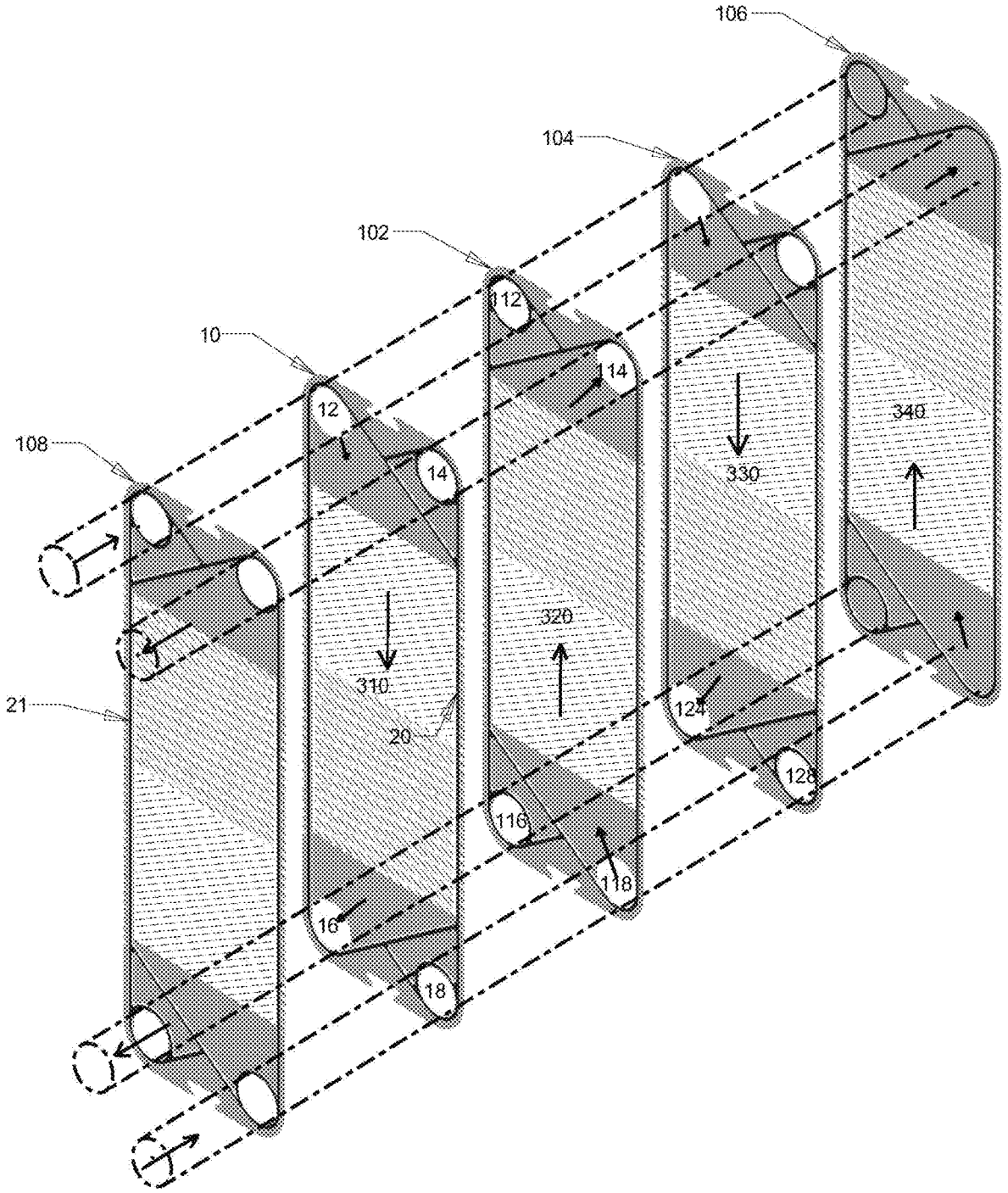
FIG. 3 is an exploded view of a heat exchanger plate pack consisting of just 5 plates according to an aspect of the disclosure.

FIG. 3 is an exploded view of a heat exchanger plate pack consisting of just 5 plates according to an aspect of the disclosure. The embodiment of the heat exchange plate pack shown in FIG. 3 has five heat exchanger plates. The number of heat exchanger plates in a plate pack may vary from three to many hundreds.

In FIG. 3, how the first heat transfer medium and the second heat transfer medium may flow through the heat exchanger plate pack 30 is illustrated. In certain embodiments, heat exchanger plate pack 30 may include none heat exchange plate 108, first heat exchanger plate 10, second heat exchanger plate 102, third heat exchange plate 104, and seal plate 106. The none heat exchange plate 108 may be configured to be fitted with end plate gasket 21 adjacent to the first end plate 42 and the seal plate 106 may be with no ports cut out adjacent to the second end plate 40. The heat exchanger plate pack 30 may include a gasket or may not include a gasket. Plates 108 and 106 are considered "none heat transfer" plates because no heat exchange takes place through the plate from the first heat transfer media to the second heat transfer media. None heat exchange plate 108 has a gasket with all four flow ports sealed by gasket so no fluid travels over the front side of this plate. The end plate gasket 21 has rubber rings around all four transfer ports and produces the plate pack seal to the first end plate 42. In this aspect of the disclosure, five heat exchanger plates are shown in the heat exchanger plate pack 30 to illustrate the flow of the heat transfer mediums. However, it is noted that only two heat exchanger plates may form a heat exchanger plate pack 30. The heat exchanger plate pack 30 may also comprise more than five heat exchanger plates.

As shown, heat exchanger plates within the heat exchanger plate pack 30 are arranged in alternating gasket groove pattern and center trough form 26 by rotation through 180 degrees. For example, the first heat exchanger plate 10 has a mirror image gasket pattern of the second heat exchanger plate 102. In this way, by way of example, a fluid passage of the first heat exchanger plate 10 may contain the first heat transfer medium, and a fluid passage of the second heat exchanger plate 102 may contain the second heat transfer medium. Therefore, the first fluid passage 310 may be configured to allow the first heat transfer medium to flow, the second fluid passage 320 may be configured to allow the second heat transfer medium to flow, and the third fluid passage 330 again may be configured to allow the first heat transfer medium to flow again.

Now, it will be explained how each heat transfer medium flows through the heat exchanger plates (10, 102, 104, 106, and 108) within the heat exchanger plate pack 30. A first flow passage 310 is formed within the boundary delineated within the flow gasket 20 on first heat exchanger plate 10 consisting of the two open ports 12 and 16, bridge gasket and the two long sides. This flow passage so enclosed enables the first heat transfer medium to travel over the front, or gasketed side of the plate 10, while the second heat transfer medium passes through the two rubber rings on ports 14 and 18 and enters the second flow passage 320 formed by the second heat transfer plate 102 and its flow gasket 20. The second heat transfer fluid passes through open ports 114 and 118 and travels over the back surface of the second heat exchanger plate 102 and front surface of the third heat transfer plate 104.

The flow arrangement produced by heat transfer plates 10 and 102 can be reproduced many times by adding any multiples of two heat transfer plates. In this way, the heat exchanger plate pack 30 containing hundreds of identical flow passages can be formed. The heat exchanger plate pack 30 is ended by adding the "seal plate" 106 which has all fluid transfer ports blocked. In this manner, the two heat transfer fluids are effectively "sealed off" and contained within the heat exchanger plate pack 30.

The first heat transfer medium enters the heat exchanger plate pack 30 through the first inlet 50 of the first end plate 42 which communicates to all other open port holes in the heat exchanger plate pack 30. The first heat transfer medium enters into every alternate flow passage, such as the first flow passage 310 and the third flow passage 330.

The first heat transfer medium exits the heat exchanger plate pack 30 through the first outlet 56 of the first end plate 42 which communicates with all other open port holes in the heat exchanger plate pack 30. The first heat transfer medium pressure in the inlet port 50 is greater than the fluid pressure in the outlet port 56, and it is this pressure difference or driving force that produces the fluid flow through the first heat transfer medium flow passage. All plates in the heat exchanger plate pack 30 have inlet and outlet ports that communicate with all other first heat transfer medium flow passages, and it means that all first flow passages have the same driving force. Provided that all plates have the identical geometry, it follows that the first heat transfer medium flow rate through each first heat transfer medium flow passage will be near identical.

In a similar manner, the second heat transfer medium enters the heat exchanger plate pack 30 through the second inlet 54 of the second end plate 42 which communicates with all other open port holes. The second heat transfer medium enters every alternate flow passage, such as the second flow passage 320 and the fourth flow passage 340.

The second heat transfer medium exits the heat exchanger plate pack 30 through the second inlet 54 of the second end plate 42 which communicates with all other open port holes in plates. The second heat transfer medium fluid pressure in the second inlet port 54 is greater than the second heat transfer medium fluid pressure in the second outlet port 52, and it is this pressure difference or driving force that produces the fluid flow through the second heat transfer medium flow passages. All plates in the heat exchanger plate pack 30 have inlet and outlet ports that communicate with all other second heat transfer medium flow passages, and it means that all second heat transfer medium flow passages have the same driving force. Provided that all plates have the identical geometry, it follows that the second heat transfer medium flow rate through each second heat transfer medium flow passage will be near identical.

By this configuration, each fluid passages may have alternating heat transfer mediums. By way of example, the first fluid passage 310 contains the first heat transfer medium flowing, the second fluid passage 320 contains the second heat transfer medium flowing. If the temperature at the inlet to first flow passages is different to that entering second flow passages, then heat transfer will take place through the plate separating the flow passages. Consider the case where the first heat transfer medium enters at a higher temperature than that of the second heat transfer medium.

According to Newtons law of heat transfer, the amount of heat exchanged is proportional to the product of the overall heat transfer coefficient, the heat transfer area and the mean temperature difference between heat transfer media.

Due to the special plate configuration that constitutes the first flow passage, the first heat exchanger plate 10 will be in a higher mean temperature than all other plates within the heat exchanger plate pack 30. This is because the first flow passage 310 transfers heat through only one heat transfer plate 10. There is no heat transfer medium flowing down the front surface of none heat transfer plate 108. All other first flow passages transfer heat through two heat transfer plates.

When the temperature of a heat exchanger plate increases, the heat exchanger plate will expand due to thermal expansion. The overall plate length and width will increase by an amount directly proportional to the temperature change of the plate metal. The first heat transfer plate 10, being hotter than all the other plates, expands to a greater extent. Because of this, the gasket center lines, port center lines and rubber ring center lines of the first heat transfer plate become no longer aligned with the center lines of all the other heat transfer plates.

The first heat transfer medium in the first flow passage 310 is hotter than all other passages, and this means that plates 10 and 108 are hotter than all the other plates in the heat exchanger plate pack 30. Plates 10 and 108 thermally expand to a greater extent than all other plates.

As expansion occurs, the metal surface of the plates 10 and 108 exert frictional force against any heat exchanger plate pack member in direct contact such as the first end plate 42. The frictional force exerted depends on many factors such as the area of contact, nature of the contacting materials (coefficient of friction), and the contact pressure. The condition of the none heat transfer plate 108 and 106 are unique in the plate pack because these both directly contact the pressure retaining end plates 42 and 40. Owing to the large contact area, these two none heat transfer plates 42, 40 experience much higher frictional forces.

When a heat exchanger is shut down, the temperature decreases until eventually it reaches ambient condition. All the plates in the heat exchanger plate pack 30 cool down and thermally contract back to their original overall dimensions. Frictional forces are again generated during plate contraction, and the hotter first heat transfer medium flow passage between the plates 10 and 108 contract to a higher extent than other plates in the heat exchanger plate pack 30. Frictional forces are produced which are opposite to the contraction of these plates but cannot prevent contraction from occurring. It cannot be guaranteed that the overall relative position of plates 10 and 108 re-aligns back to the original position.

The frictional forces that occur on expansion or contraction can result in a movement of the entire plate either upwards or downwards. This movement stops when no further temperature change happens. If the relative position of the gasket sealing face moves off of the mating metal sealing surface of the adjacent plate, then the seal is lost, and leakage will commence. It is very rare that the degree of plate movement caused by a single startup and shut down event is sufficient to lose gasket seal. However, over the course of several startup and shut down cycles or when the duty is none steady state, then the movement of plates can become more extreme with the plates slowly migrating out of alignment with each successive temperature change event. As the heat exchanger plates move relatively, a gasket 20 may come off from the groove 11. To prevent this, a lock strip 400 may be provided to produce a restorative force that acts to re-align adjacent plates.

Figure 4:
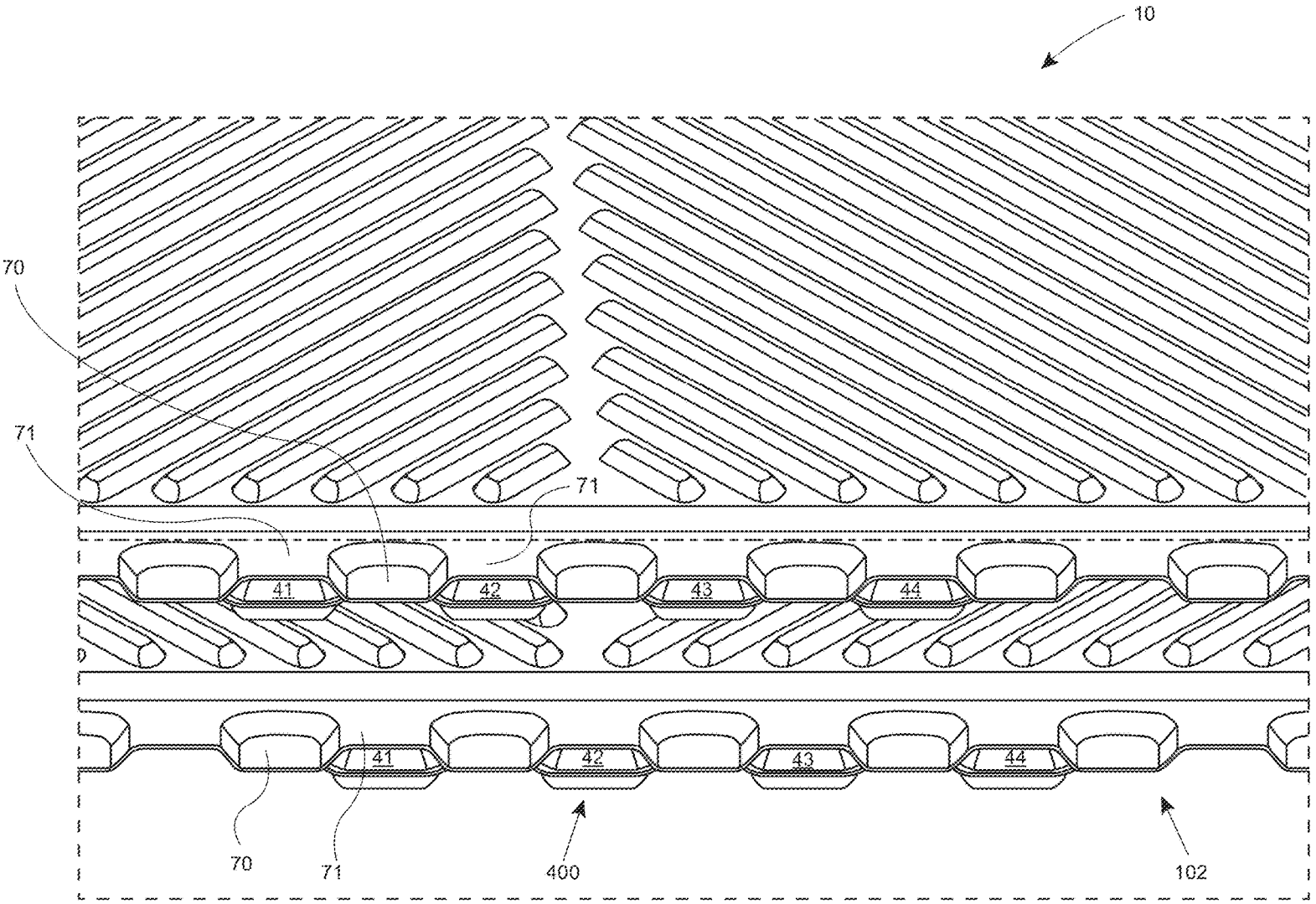
FIG. 4 is an exploded view of a plate, gasket and lock strip assembly on two adjacent plates in a heat exchanger pack according to an aspect of the disclosure.

FIG. 4 is an exploded view of a plate, gasket and lock strip assembly on two adjacent plates in a heat exchanger pack according to an aspect of the disclosure.

In FIG. 4, a lock strip 400 is arranged on two adjacent heat exchanger plates. The purpose of the lock strip 400 is to allow some degree of relative displacement between adjacent plates but prevent any large misalignment between adjacent plates. FIG. 4 shows that the lock strip is fitted onto the back side of the heat transfer plates but the invention is not limited to this position.

FIG. 4 shows the plate edges to consist of alternating projections 71 upwards and indentations downwards 70. This plate feature is called a castellated edge. Adjacent plates in a compressed heat exchanger plate pack 30 have the indentations 70 of the top plate contacting the projections of the lower plate such that the heat exchanger plate pack 30 viewed from side may look like a honeycomb structure. The lock strip 400 is trapped within the space formed by the projection 71 on the top plate and the indentation 70 on the bottom plate. Viewed from side of the lock strip appears to "fill in" the spaces of the honeycomb.

The lock strip 400 has first projection 41 that fit up into the projections 71 in the top plate and the first projections 41 also fit downwards into the indentations 70 of the plate below.

Any relative displacement between adjacent plates that have a lock strip 400 trapped between causes the plates to exert a shearing force on the lock strip projections. These lock strip projections in turn exert an equal and opposite counterforce on the plate indentations or projections which acts to restore plate to plate alignment. The larger the relative displacement (misalignment) between adjacent plates, the higher the restorative force generated by the misalignment. This stored energy within a deformed lock strip 400, like a spring, is made available to realign plates when operating conditions allow. In this way, lock strip 400 is configured to maintain alignment of the first heat exchanger plate 10 and the second heat exchanger plate 102 over a plurality of thermal expansion and contraction cycles of the plates. The lock strip 400 may be installed on an edge of a heat exchanger plate and does not overlap with gasket 20.

To allow some degree of thermal expansion of heat exchanger plates, the lock strip 400 may be made from an elastic material. The lock strip 400 may be made from a rubber material. The lock strip 400 may be made from EPDM (ethylene propylene diene monomer) rubber or any other elastic material with suitable mechanical properties. For example, the material of the lock strip 400 may have IRHD value of 75-83.

Figure 5:
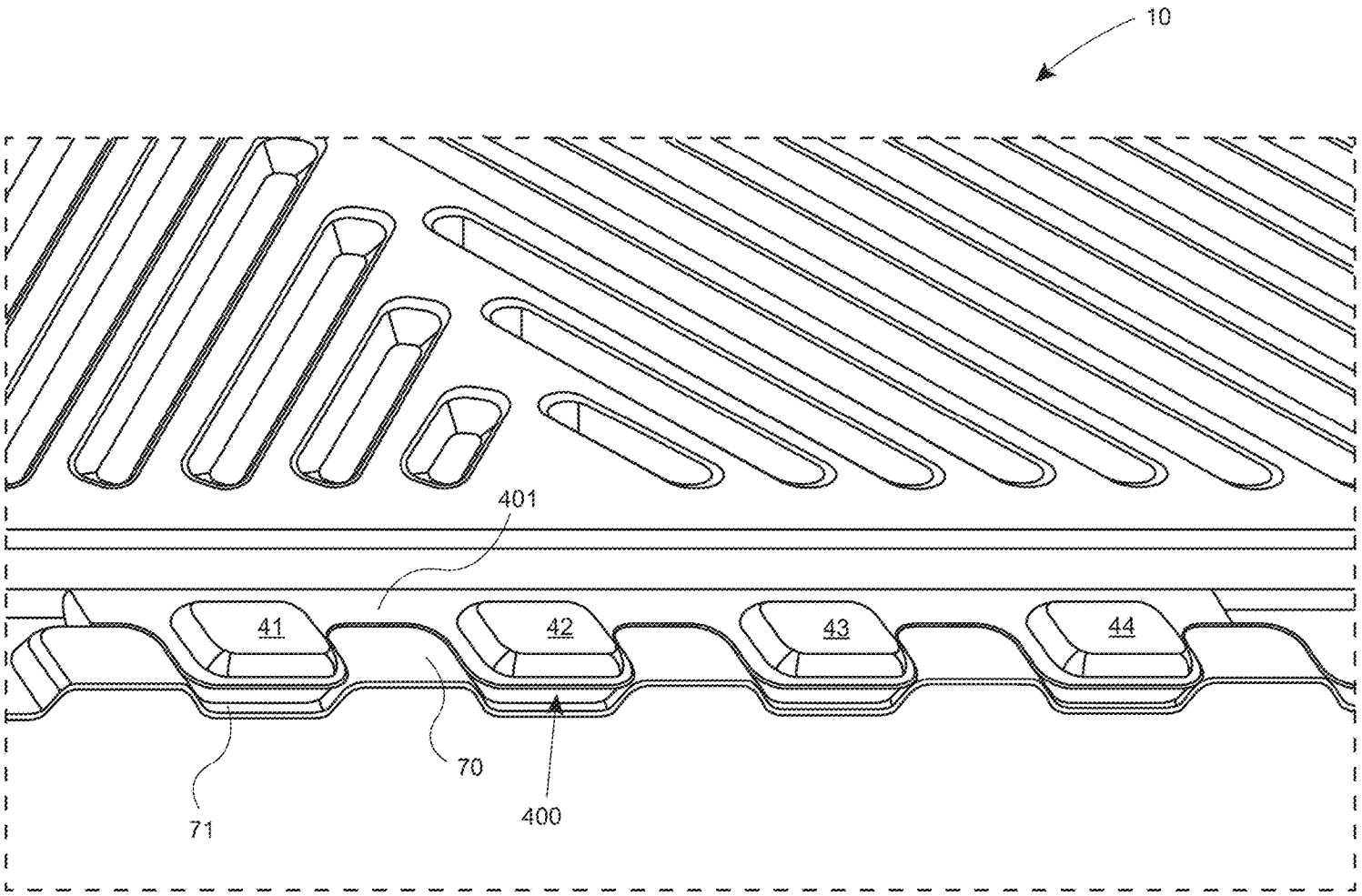
FIG. 5 is a perspective view of an exemplary lock strip on the rear plate surface according to an aspect of the disclosure.

FIG. 5 is a perspective view of an exemplary lock strip on the rear plate surface according to an aspect of the disclosure.

FIG. 5 shows the reverse view of heat transfer plate 10 with one lock strip 400 attached and can be used to better show how a lock strip is retained. In this aspect of the disclosure, the lock strip 400 consists of four projections 41, 42, 43 and 44 all joined by a common "header" 401 (also called as a hook-shaped region). A lock strip 400 is not limited to four projections and can contain any number equal to or greater than one. A first projection 41 configured to engage with a first indentation 71 (also shown in FIG. 4) on the first heat exchanger plate 10 and projection 42, 43, and 44 all sitting in similar indentations on the heat exchanger plate 10. All lock strip projections 41, 42, 43, and 44 and header 401 loop around the projections 70 of the heat exchanger plate 10.

Back to FIG. 4, the lock strip projections 41, 42, 43, and 44 on the heat exchanger plate 10 fit down into the indentations 70 of the second heat exchanger plate 102. When the second heat exchanger plate 102 is pressed against the first heat exchanger plate 10, its projections 41, 42, 43, and 44 contact the projection of the first heat exchanger plate 10. The common header 401 is now trapped behind the indentations of the first heat exchanger plate 10. The lock strip 400 is now secured when the heat exchanger plates are pressed together in the heat exchanger plate pack 30. The lock strips may be kept in place prior to the heat exchanger plate pack 30 compression by using an adhesive.

Figure 6:
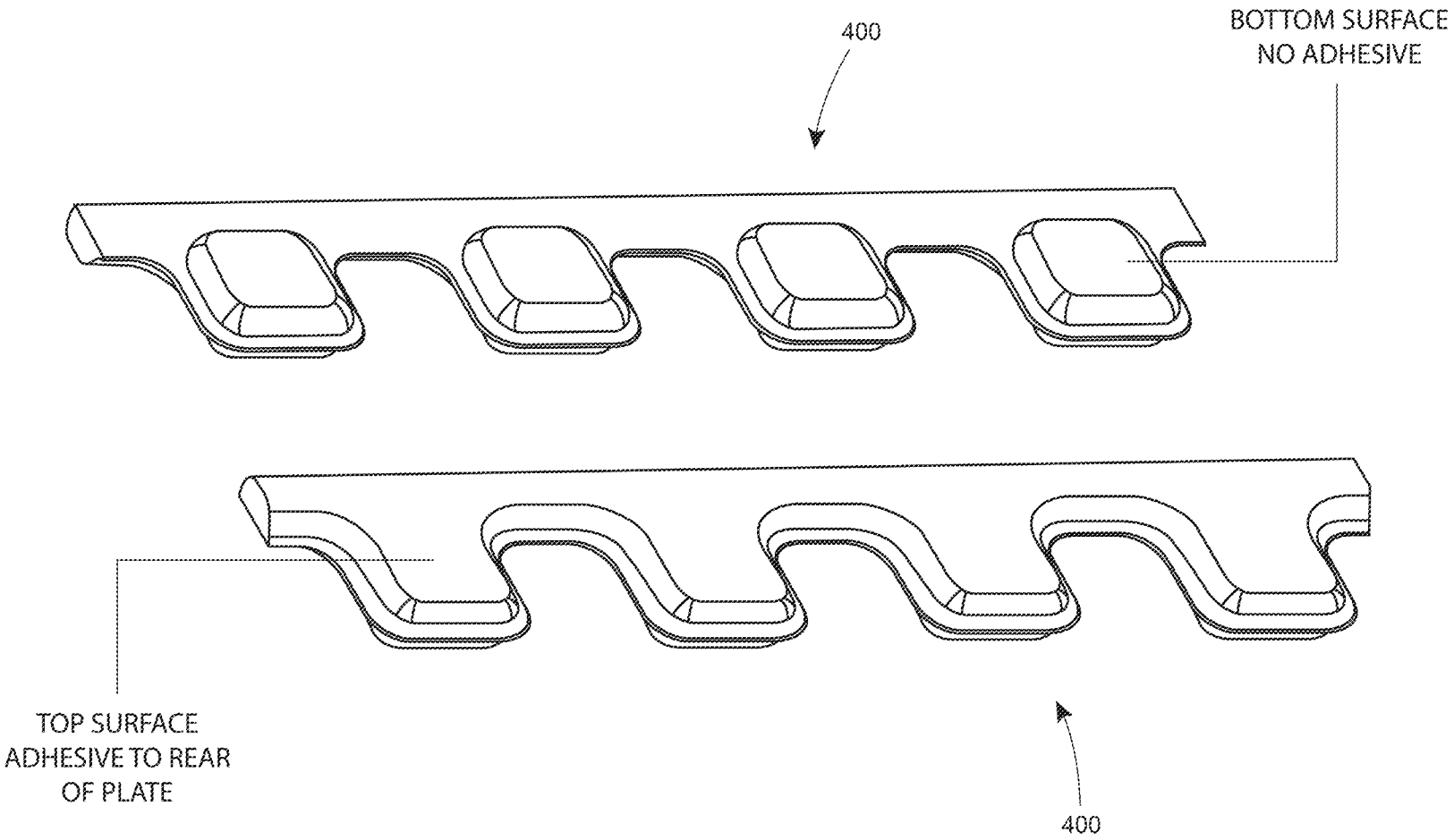
FIG. 6 is a perspective view of a lock strip front surface and back surface according to an aspect of the disclosure.

FIG. 6 is a perspective view of a lock strip front surface and back surface according to an aspect of the disclosure. To attach the lock strip 400 in position on the rear of the plate, the top surface of the strip may have adhesive applied before the lock strip 400 is pressed into place. It will be understood that the edge of the heat exchanger plate consisting of indentations 70 and projections 71 that form a repeating pattern such that the lock strip as shown can be fitted in a variety of locations, and more than one lock strip may be applied down each of the two long outside edges of the heat exchanger plate.

Figure 7:
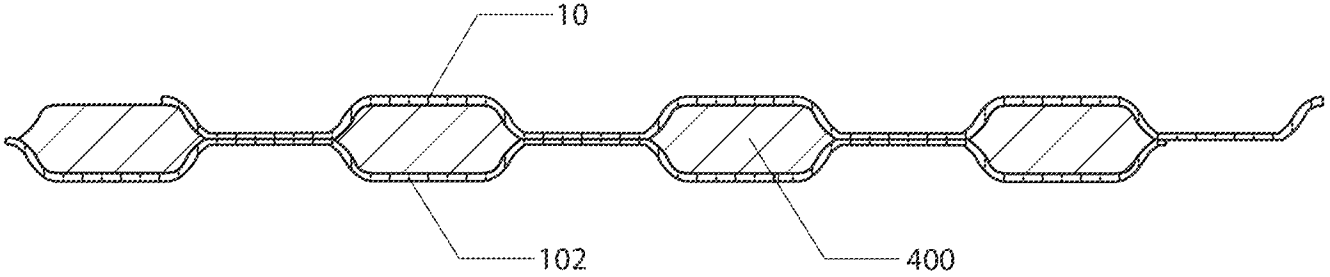
FIG. 7 is a cross section view of a lock strip arranged between two adjacent plates which are correctly aligned according to an aspect of the disclosure.

FIG. 7 is a cross section view of a lock strip arranged between two heat exchanger plates in perfect alignment according to an aspect of the disclosure.

In FIG. 7, lock strip 400 is trapped between the first and the second heat exchanger plates 10 and 102 which are in perfect alignment. The top half of lock strip 400 fits into the projections of the first heat exchanger plate 10, while the bottom half of the lock strip 400 fits into the indentation of the second heat exchanger plate 102. If plates 10 and 102 are aligned, no shearing forces are applied to the lock strip projections.

Figure 8:
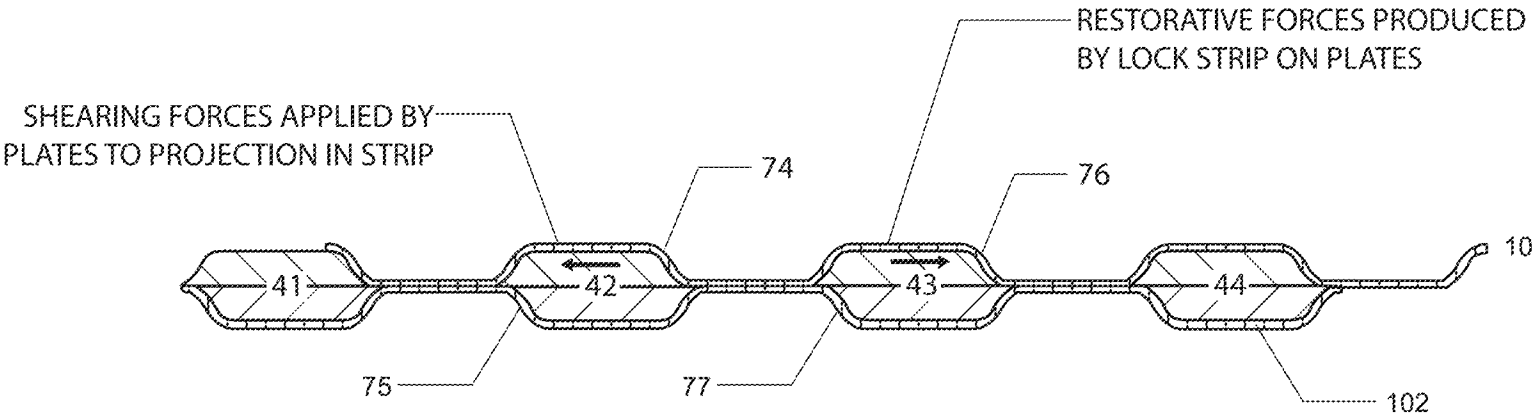
FIG. 8 is a cross section view of a lock strip arranged between two plates that are mis-aligned along the long axis according to an aspect of the disclosure.

FIG. 8 is a cross section view of a lock strip arranged between two plates that are mis-aligned along the long axis according to an aspect of the disclosure.

In FIG. 8, the top plate 10 is displaced to the left relative to the bottom plate 102. Consider the effect of this displacement on lock strip projection 42. The first side walls or "flanks" 74 projection of the top plate 10 exerts a force on the lock strip projection 42 displacing lock strip material on the top half of the strip to the left while the second side wall or "flanks" 75 of indentation of the bottom plate 102 acts on the lock strip projection 42 displacing the bottom half of the projection to the right. In this way, the lock strip projection 42 experiences a net shearing force. All projections 41, 42, 43, and 44 in lock strip 400 experience the same amount of displacement and are sheared to an equal extent.

Due to the elastic properties of the lock strip, as projection 43 is deformed, it acts like a spring. The elastic molecular structure of projection 43 exerts an equal and opposite force to that of the shearing force applied to the lock strip 400 and acts on the mis-aligned plate surfaces "flanks" 76 and 77. These restorative forces act to realign the two displaced projections in plate 10 and indentation in plate 102. All lock strip projections 41, 42, 43 and 44 exert the same restorative force on the "flanks" that they contact.

Lock strips 400 are modular and any number of lock strips 400 can be added down the entire long axis of the plates 10 on either side so that many projections can exert a large restorative force sufficient to limit the amount of relative plate to plate misalignment that can occur due to temperature cycling. By limiting the plate mis-alignment, loss of gasket seal can be prevented.

Figure 9:
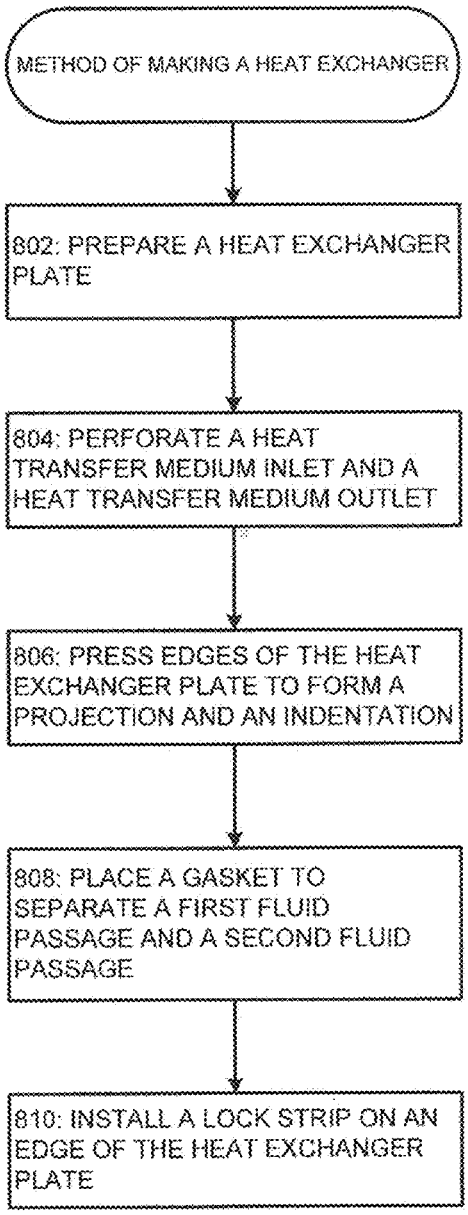
FIG. 9 illustrates a method of making a heat exchanger plate with improved leak prevention according to an aspect of the disclosure.

FIG. 9 illustrates a method of making a heat exchanger plate with improved leak prevention according to an aspect of the disclosure.

In FIG. 9, a method of making a heat exchanger with improved leak prevention is illustrated. In an aspect of the disclosure, a method of preparing a heat exchanger with improved leak prevention may include: preparing a heat exchanger plate, perforating at least one heat transfer medium inlet and at least one heat transfer medium outlet, pressing edges of the heat exchanger plate to form a projection and an indentation, placing a gasket to separate a first fluid passage and a second fluid passage, and installing a lock strip on at least one edge of the first heat exchanger plate such that a projection of the lock strip engages with the indentation of the heat exchanger plate and a hook-shaped region surrounds the projection of the heat exchanger plate.

Now, a method of making a heat exchanger with improved leak prevention will be discussed in more detail. First, a first heat exchanger plate 10 may be prepared (802). The first heat exchanger plate 10 may be perforated to create at least one heat transfer medium inlet and at least one heat transfer medium outlet (804). The first heat exchanger plate 10 may be also perforated to create a first heat transfer medium inlet 12, a first heat transfer medium outlet 16, a second heat transfer medium inlet 14, and a second heat transfer medium outlet 18.

The first heat exchanger plate 10 may then be pressed on an edge to form at least one projection 71 (806). The first heat exchanger plate may also be pressed on the edge to form at least on indentation 70 (806). At least some portion of the first heat exchanger plate's edge may be pressed to form alternating projections and indentations. The alternating projections and indentations may be formed on two long edges of the first heat exchanger plate 10. All four edges of the first heat exchanger plate 10 may be pressed to form alternating projections and indentations.

A gasket 20 may be placed to separate a first fluid passage and a second fluid passage (808). One gasket 20 may be configured to separate the first fluid passage and the second fluid passage. Alternatively, a first gasket may be configured to seal the first fluid passage, and the second gasket may be configured to seal the second fluid passage, or vice versa.

A lock strip 400 may be installed on an edge of the first heat exchanger plate 10 (810). The lock strip 400 may include a first projection 41 configured to engage with the indentation 71 on the first heat exchanger plate 10. The lock strip may include more than two projections and may be configured to engage with the alternating projection and indentation of the first heat exchanger plate 10. More than one lock strip may be installed on the edge of the first heat exchanger plate 10. When more than one lock strip is installed on the edge of the first heat exchanger plate 10, at least one lock strip may be installed on each long edge of the first heat exchanger plate 10.

Figure 10:
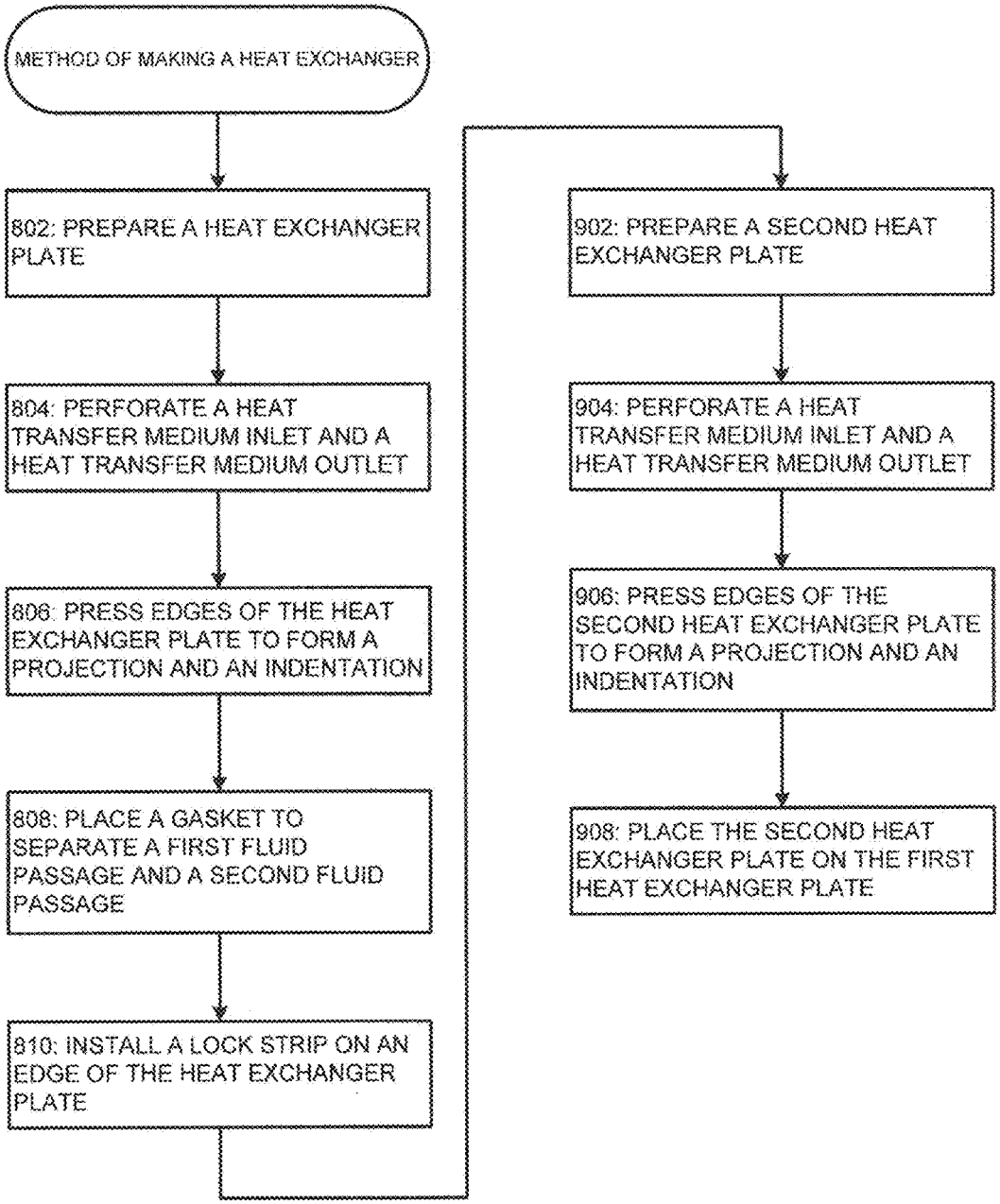
FIG. 10 illustrates a method of making a heat exchanger plate with improved leak prevention according to another aspect of the disclosure.

FIG. 10 illustrates a method of making a heat exchanger plate with improved leak prevention according to another aspect of the disclosure.

In another aspect of the disclosure, a method of preparing a heat exchanger with improved leak prevention may include: preparing a second heat exchanger plate, perforating at least one heat transfer medium inlet and at least one heat transfer medium outlet, pressing edges of the second heat exchanger plate to form a projection and an indentation, and placing the second heat exchanger plate on the first heat exchanger plate such that the projection of the lock strip engages with the indentation of the second heat exchanger plate and the hook-shaped region surrounds the projection of the second heat exchanger plate.

Now, another aspect of a method of making a heat exchanger with improved leak prevention will be discussed in more detail. A second heat exchanger plate 102 may be prepared (902). As the first heat exchanger plate 10, the second heat exchanger plate 102 may be perforated to create at least one heat transfer medium inlet and at least one heat transfer medium outlet (904). The second heat exchanger plate 102 may be also perforated to create a first heat transfer medium inlet 112, a first heat transfer medium outlet 116, a second heat transfer medium inlet 114, and a second heat transfer medium outlet 118.

The second heat exchanger plate 102 may then be pressed on an edge to form at least one projection 78 (906). The first heat exchanger plate may also be pressed on the edge to form at least on indentation 72 (906). At least some portion of the second heat exchanger plate's edge may be pressed to form alternating projections and indentations. The alternating projections and indentations may be formed on two long edges of the second heat exchanger plate 102. All four edges of the second heat exchanger plate 102 may be pressed to form alternating projections and indentations.

The second heat exchanger plate 102 may be placed on the first heat exchanger plate 10 so that the gasket 20 may separate the first fluid passage and the second fluid passage between the first heat exchanger plate 10 and the second heat exchanger plate 102 (908). The first heat exchanger plate 10 and the second heat exchanger plate 102 may include a heat exchanger plate pack 30. Additionally, a groove 11 may be formed so that the gasket 20 may be secured on the surfaces of the first heat exchanger plate 10 and the second heat exchanger plate 102. When the second heat exchanger plate 102 is placed on the first heat exchanger plate 10, the second heat exchanger plate is placed so that a second projection 42 of the lock 400 may be engaged with an indentation of the second heat exchanger plate 102. In case the lock strip 400 is configured with a third and fourth projections, they may be configured to engage with a second indentation of the first heat exchanger plate 10 and a second indentation of the second heat exchanger plate 102. If there are more than one lock strip installed on the first heat exchanger plate 10, every projection of the lock strips may be engaged with indentations of the second heat exchanger plate 102.

Additionally, a first end plate 40 and a second end plate 42 may be prepared. The heat exchange plate pack 30 may be placed between the first end plate 40 and the second end plate 42. The first end plate 40 and the second end plate 42 may be pressed such that the heat exchanger plate pack 30 may be pressed with an appropriate pressure. The pressure may be calculated to secure the gasket 20 placed between the first heat exchanger plate 10 and the second heat exchanger plate 102. A tightening member 60 may be connected between the first end plate 40 and the second end plate 42. The pressure may be adjusted by rotating the tightening member 60. The lock strip 400 installed between the first heat exchanger plate 10 and the second heat exchanger plate 102 may also be pressed by the pressure by the tightening member 60. When a first heat transfer medium flows through the first fluid passage, the first heat exchanger plate 10 and the gasket 20 will expand. The lock strip 400 will permit full expansion of the heat exchanger plate and the gasket to occur but will act to limit any relative displacement between the two plates in the same plane as the plates.

See FIG. 3. A heat exchanger plate pack 30 is constructed when one or more flow plates 10 each fitted with lock strips are placed together alternating each adjacent plate being 180 degree inverted. Note when plate 10 is inverted it becomes plate 102. The first none flow plate 108 is fitted with lock strips and end gasket 21 whereas the final flow plate 106 has no flow ports pierced, has no lock strips fitted but is fitted with flow gasket 20.

The many features and advantages of the disclosure are apparent from the detailed specification, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

What is claimed is:

1. A heat exchanger with improved leak prevention comprising:
- a first heat exchanger plate having first fluid passages and second fluid passages;
- a second heat exchanger plate having first fluid passages and second fluid passages;
- a gasket arranged between the first and second heat exchanger plates and configured to separate the first fluid passages from the second fluid passages; and
- a lock strip arranged between the first and second heat exchanger plates and configured to maintain alignment of the first and second heat exchanger plates over a plurality of thermal expansion and contraction cycles of the plates.

2. The heat exchanger according to claim 1, wherein the lock strip has a first projection configured to engage with a first projection of the first heat exchanger plate and a second projection configured to engage with a first indentation on the second heat exchanger plate.

3. The heat exchanger according to claim 2, wherein the lock strip has a third projection configured to engage with a second projection of the first heat exchanger plate and a fourth projection configured to engage with a second indentation of the second heat exchanger plate.

4. The heat exchanger according to claim 2, wherein the lock strip is configured to surround a projection of the first heat exchanger plate.

5. The heat exchanger according to claim 1, wherein a plurality of lock strips are arranged between the first heat exchanger plate and the second heat exchanger plate.

6. The heat exchanger according to claim 1, wherein the first heat exchanger plate and the second heat exchanger plate comprise a heat exchanger plate pack, and a lock strip is interposed within the heat exchanger plates in the heat exchanger plate pack.

7. The heat exchanger according to claim 6, wherein a plurality of lock strips is installed between first two plates in the heat exchanger plate pack and last two plates in the heat exchanger plate pack.

8. The heat exchanger according to claim 7, wherein a plurality of lock strips are installed between first three plates in the heat exchanger plate pack and last three plates in the heat exchanger plate pack.

9. The heat exchanger according to claim 1, wherein the lock strip is made from an elastic material.

10. The heat exchanger according to claim 9, wherein the lock strip is made from EPDM (ethylene propylene diene monomer) rubber.

11. The heat exchanger according to claim 1 further comprising:
- a first end plate;
- a second end plate; and
- at least one tightening member connected to the first end plate and the second end plate and configured to compress the first heat exchange plate and the second heat exchanger plate.

12. A lock strip for maintaining alignment of heat exchanger plates, comprising:
- a first projection configured to engage with a first projection of a first heat exchanger plate;
- a second projection configured to engage with a first indentation of a second heat exchanger plate; and
- a hook-shaped region configured to surround an indentation of the first heat exchanger plate.

13. The lock strip according to claim 12, further comprising:
- a third projection configured to engage with a second projection of the first heat exchanger plate; and
- a fourth projection configured to engage with a second indentation of the second heat exchanger plate;
- wherein the hook-shaped region is configured to surround an indentation of the second heat exchanger plate.

14. A method of making a heat exchanger with improved leak prevention comprising steps of:
- preparing a first heat exchanger plate;
- perforating at least one heat transfer medium inlet and at least one heat transfer medium outlet;
- pressing edges of the first heat exchanger plate to form a projection and an indentation;
- placing a gasket to separate a first fluid passage and a second fluid passage; and
- installing a lock strip on at least one edge of the first heat exchanger plate such that a projection of the lock strip engages with the indentation of the first heat exchanger plate and a hook-shaped region surrounds the projection of the first heat exchanger plate.

15. The method of making a heat exchanger for improved leak prevention as in claim 14, further comprising steps of:

preparing a second heat exchanger plate;

perforating at least one heat transfer medium inlet and at least one heat transfer medium outlet;

pressing edges of the second heat exchanger plate to form a projection and an indentation; and placing the second heat exchanger plate on the first heat exchanger plate such that the projection of the lock strip engages with the indentation of the second heat exchanger plate and the hook-shaped region surrounds the projection of the second heat exchanger plate.

16. The method of making a heat exchanger for improved leak prevention as in claim 15, further comprising steps of:

preparing a first end plate and a second end plate; and placing the two heat exchanger plates between the first end plate and the second end plate.

17. The method of making a heat exchanger for improved leak prevention as in claim 16, further comprising steps of:

connecting a tightening member to the first end plate and the second end plate; and applying a force normal to the heat exchanger plate by tightening the tightening member.

* * * * *